US010159906B1

(12) United States Patent
Bernard et al.

(10) Patent No.: US 10,159,906 B1
(45) Date of Patent: Dec. 25, 2018

(54) SPARKING JUMP ROPE

(71) Applicants: Elaine Bernard, Culver City, CA (US); Vernon Lee Roddy, III, Culver City, CA (US); Julard Jaevon Roddy, Culver City, CA (US); Julianne Evona Roddy, Culver City, CA (US)

(72) Inventors: Elaine Bernard, Culver City, CA (US); Vernon Lee Roddy, III, Culver City, CA (US); Julard Jaevon Roddy, Culver City, CA (US); Julianne Evona Roddy, Culver City, CA (US)

( * ) Notice: Subject to any disclaimer, the term of this patent is extended or adjusted under 35 U.S.C. 154(b) by 0 days.

(21) Appl. No.: 15/438,560

(22) Filed: Feb. 21, 2017

Related U.S. Application Data

(63) Continuation-in-part of application No. 15/053,938, filed on Feb. 25, 2016, now Pat. No. 9,707,492.

(51) Int. Cl.
*A63B 5/20* (2006.01)
*A63H 33/36* (2006.01)

(52) U.S. Cl.
CPC ..... *A63H 33/36* (2013.01); *A63B 5/20* (2013.01)

(58) Field of Classification Search
CPC ..... A63B 5/20; A63B 2208/12; A63B 2071/0625; A63B 5/22; A63B 2207/02; A63B 21/0004; A63B 21/4043; A63H 33/36
USPC ..... 482/81–82
See application file for complete search history.

(56) References Cited

U.S. PATENT DOCUMENTS

| | | | | |
|---|---|---|---|---|
| 9,707,492 | B1 * | 7/2017 | Bernard | A63H 33/36 |
| 2001/0023220 | A1 * | 9/2001 | Bouvier | A63B 5/20 482/82 |
| 2004/0218383 | A1 * | 11/2004 | Bailey, III | A63B 5/20 362/169 |
| 2007/0202286 | A1 * | 8/2007 | Jacobs | D07B 1/141 428/36.3 |
| 2011/0077133 | A1 * | 3/2011 | Oesterling | A63B 5/20 482/82 |
| 2014/0080680 | A1 * | 3/2014 | Henniger | A63B 5/20 482/82 |
| 2014/0228180 | A1 * | 8/2014 | Walker | A63B 5/20 482/82 |
| 2015/0135768 | A1 * | 5/2015 | Barrick | A44C 15/005 63/1.12 |
| 2016/0067536 | A1 * | 3/2016 | Carpinelli | A63B 5/20 482/82 |

OTHER PUBLICATIONS

Ron Red Bear Lake. "Tashi Spinning fire Jump rope." Youtube Video (https://youtu.be/GljD0IMym24). Published Oct 28, 2011.*

* cited by examiner

*Primary Examiner* — Andrew S Lo
(74) *Attorney, Agent, or Firm* — Plager Schack LLP

(57) ABSTRACT

A sparking jump rope configured to emit sparks while a user is jumping rope includes a rope made of a non-sparking material; and a sparking portion positioned along a length of the rope, the sparking portion configured to create sparks when the jump rope contacts a ground surface. The sparking portion may include at least one spark pad made of a flint material.

3 Claims, 3 Drawing Sheets

SPARKING JUMP ROPE

RELATED APPLICATION

This application is a continuation in part of U.S. Ser. No. 15/053,938, filed on Feb. 25, 2016, the entire contents of which is herein incorporated by reference.

BACKGROUND

The embodiments herein relate generally to toys and games, and more particularly, to a jump rope that sparks when it contacts the ground Conventional jump ropes consist of a rope, cord, or similar item with a handle at each end. However, conventional jump ropes lack excitement and flair.

Therefore, what is needed is a jump rope that sparks when it contacts the ground, bringing excitement back to jumping rope.

SUMMARY

Some embodiments of the present disclosure include a sparking jump rope configured to emit sparks while a user is jumping rope. The sparking jump rope may include a rope; and a sparking portion positioned along a length of the rope, the sparking portion configured to create sparks when the jump rope contacts a ground surface. The sparking portion may be a solid piece of sparking material, such as a spark pad, and the rope may be made of a non-sparking material.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
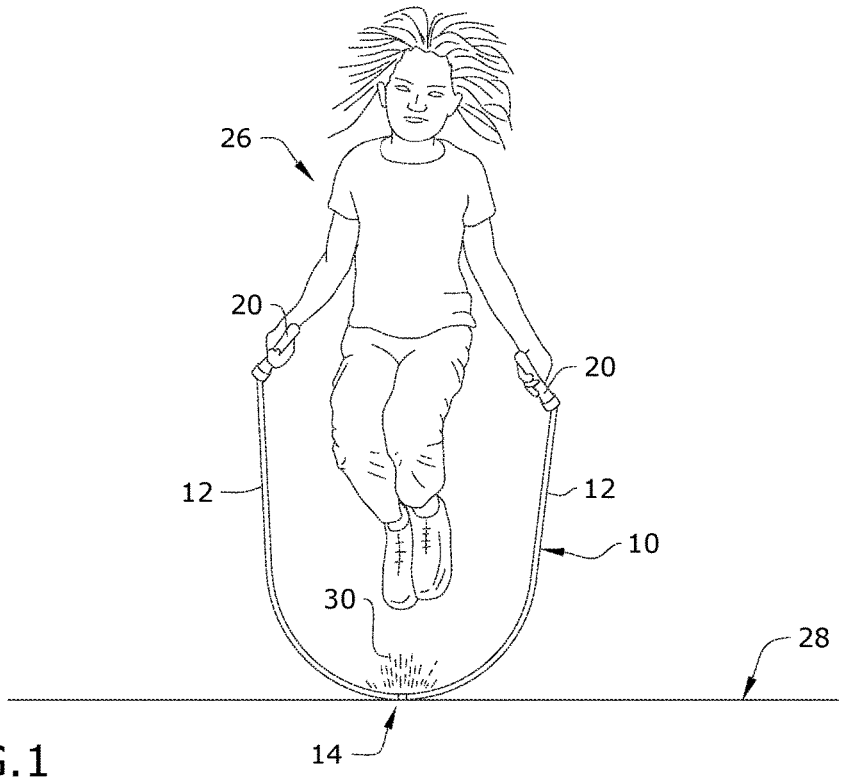
FIG. 1 is a perspective view of one embodiment of the present disclosure, shown in use.
Figure 2:
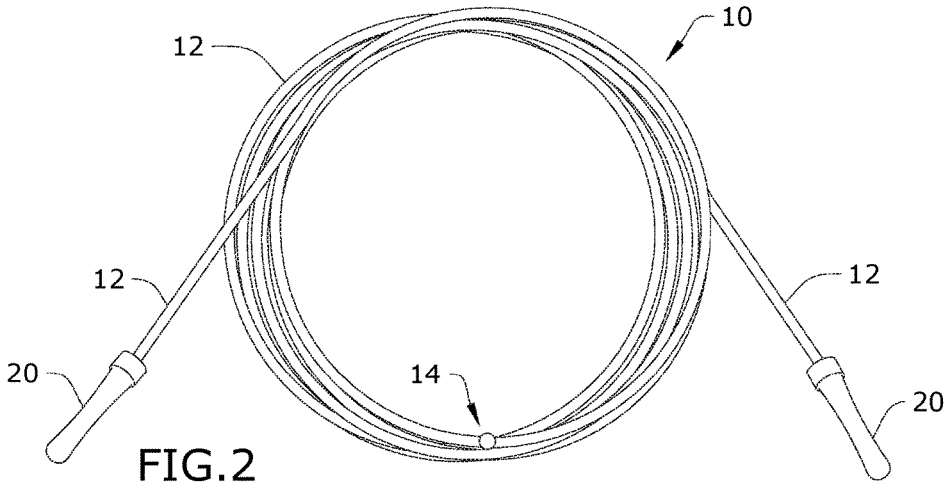
FIG. 2 is a top view of one embodiment of the present disclosure.
Figure 3:
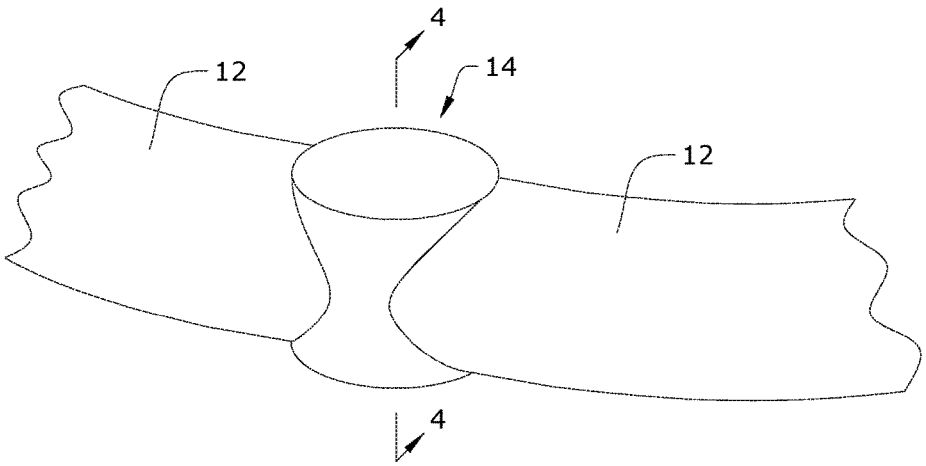
FIG. 3 is a detail perspective view of one embodiment of the present disclosure.
Figure 4:
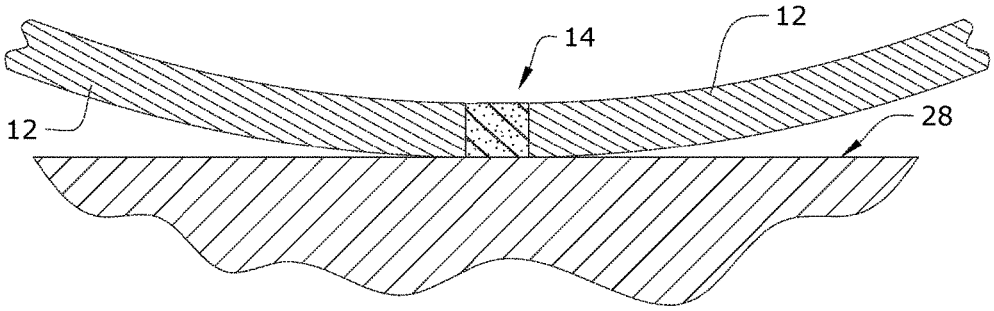
FIG. 4 is a section view of one embodiment of the present disclosure, taken along line 4-4 in FIG. 3.

In the following detailed description of the invention, numerous details, examples, and embodiments of the invention are described. However, it will be clear and apparent to one skilled in the art that the invention is not limited to the embodiments set forth and that the invention can be adapted for any of several applications.

The device of the present disclosure may be used as a jump rope that sparks when it contacts the ground and may comprise the following elements. This list of possible constituent elements is intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device.

1. Rope Portion
2. Sparking Portion

The various elements of the device of the present disclosure may be related in the following exemplary fashion. It is not intended to limit the scope or nature of the relationships between the various elements and the following examples are presented as illustrative examples only.

By way of example, and referring to FIGS. 1-11, some embodiments of the present disclosure include a sparking jump rope 10 comprising a sparking portion 14 positioned along a length of a rope 12, the sparking portion creating sparks when the jump rope 10 contacts the ground 28. As shown in the Figures, the sparking portion may be positioned proximate to a central area of the rope 12 such that the sparking portion contacts the ground 28, creating sparks 30 when the jump rope 10 is used by a user 26.

In embodiments, the rope 12 may comprise a non-sparking material, such that the jump rope 10 only produces sparks 30 when the sparking portion contacts the ground 28. For example, the rope 12 may comprise nylon, plastic, or the like.

Figure 5:
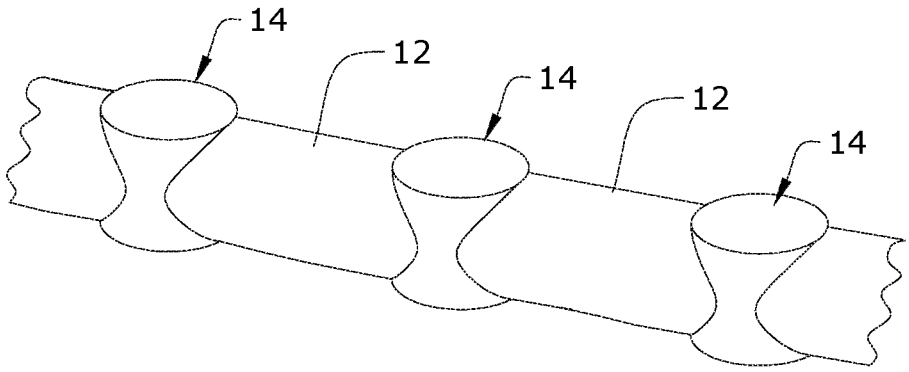
FIG. 5 is a perspective view of one embodiment of the present disclosure.

In embodiments, the sparking portion may comprise at least one spark pad 14 built into the rope 12, wherein the spark pad 14 comprises a solid sparing material, such as flint. Thus, the sparking portion may comprise a first material (the spark pad 14), while the rope 12 may comprise a second material (a non-sparking material). As shown in FIG. 5, a single jump rope 10 may comprise a plurality of spark pads 14 spaced along a length of the rope 12, such that the non-sparking material rope 12 is sandwiched between each adjacent spark pad 14.

In alternate embodiments (not shown), the sparking portion may be a hollow portion of the rope, wherein the sparking portion has outer walls and an inner cavity with a volume sufficient to accommodate at least one spark rock, wherein the outer walls comprise a plurality of orifices, wherein the orifices have a size large enough for at least a portion of the spark rock may contact the ground 28, and the orifices are also smaller in size than a diameter of the spark rock, such that the spark rock will not fall out of the sparking portion through the orifices. In embodiments, the sparking portion may contain a plurality of spark rocks, wherein the spark rocks create sparks 30 when a first spark rock contacts an adjacent spark rock and the resulting sparks 30 exit the sparking portion through the orifices. Thus, the spark rocks may not have to contact the ground 28 to create sparks 30.

In yet further embodiments, the sparking portion may be a removable attachment (not shown). For example, the removable sparking attachment may clip around or otherwise attach to any conventional jump rope, such as rope 12. Thus, the present disclosure also includes an attachment that may be fastened to any conventional jump rope to turn it into a sparking jump rope 10. When included, the fastener used to attach the sparking portion to the rope 12 may be any suitable and known fastener.

The spark rocks or sparking portion may be made of any suitable material configured to produce sparks 30 when contacting another spark rock, sparking portion, or the ground 28. In embodiments, the spark rocks or sparking portion may have to contact adjacent spark rocks or the ground at a suitable force in order to emit sparks 30. Exemplary materials for the spark rocks or the sparking portion include metal, flint, steel, titanium, crystalline, or the like.

While the sparking portions are described as being positioned in a substantially centrally located portion along the length of the rope 12, the sparking portion may be positioned at any suitable location along the length of the rope 12. Additionally, the sparking portions may come in varying sizes with varying numbers of spark rocks or with varying sparking material depending on the desired intensity of the sparking.

As with conventional jump ropes, the jump rope 10 of the current disclosure may also comprise a handle 20 at either end of the rope 12, wherein the handles 20 provide a user 26 with a specific area of the jump rope 10 to grip. Similarly, the jump rope 10 of the present disclosure may comprise any additional features that conventional jump ropes may include, such as decorative features.

To use the jump rope 10 of the present disclosure, a user 26 would jump rope as normal. However, when the jump rope 10 contacts the ground 28, sparks 30 may be produced by either spark rocks colliding or hitting the ground, or the sparking portion or spark pad 14 hitting the ground 28.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A sparking jump rope configured to emit sparks while a user is jumping rope, the sparking jump rope comprising:

a rope comprising a non-sparking material; and a sparking portion positioned along a length of the rope, the sparking portion configured to create sparks when the jump rope contacts a ground surface, wherein:

the sparking portion comprises at least one spark pad integrated into the rope; and the at least one spark pad comprises flint.

2. The sparking jump rope of claim 1, wherein the sparking jump rope comprises a plurality of spark pads spaced a long a length of the rope, such that a portion of the non-sparking material rope is sandwiched between each adjacent spark pad.

3. The sparking jump rope of claim 1, the sparking portion is positioned proximate to a central area of the length of the rope.

* * * * *